US011634246B2

(12) United States Patent
Kraaijestein et al.

(10) Patent No.: US 11,634,246 B2
(45) Date of Patent: Apr. 25, 2023

(54) DISPENSER FOR STRETCH FILM

(71) Applicant: Ei Beheer B.V., Etten-Leur (NL)

(72) Inventors: Peter Kraaijestein, Etten-Leur (NL); René Van Glabbeek, Etten-Leur (NL)

(73) Assignee: Ei Beheer B.V., Etten-Leur (NL)

( * ) Notice: Subject to any disclaimer, the term of this patent is extended or adjusted under 35 U.S.C. 154(b) by 75 days.

(21) Appl. No.: 17/112,981

(22) Filed: Dec. 5, 2020

(65) Prior Publication Data

US 2021/0171232 A1 Jun. 10, 2021

(30) Foreign Application Priority Data

Dec. 6, 2019 (NL) ..... 2024399

(51) Int. Cl.

| | |
|---|---|
| ***B65B 67/08*** | (2006.01) |
| ***B65H 16/10*** | (2006.01) |
| ***B65H 23/14*** | (2006.01) |
| ***B65B 65/02*** | (2006.01) |

(Continued)

(52) U.S. Cl.

CPC ..... *B65B 67/085* (2013.01); *B65H 16/106* (2013.01); *B65H 23/14* (2013.01); *B65B 59/04* (2013.01); *B65B 65/02* (2013.01); *B65B 2011/002* (2013.01);

(Continued)

(58) Field of Classification Search

CPC ..... B65B 67/085; B65B 2011/002; B65B 59/003; B65B 59/04; B65B 41/16; B65B 65/02; B65B 67/08; B65H 16/005; B65H 2402/412; B65H 2701/1944; B65H 2515/322; B65H 2220/04; B65H 2403/42; B65H 16/06; B65H 16/106; B65H 2301/41346; B65H 23/06; B65H 23/14;

(Continued)

(56) References Cited

U.S. PATENT DOCUMENTS 3,828,998 A * 8/1974 Gross ..... B65H 23/0256 222/413
4,336,679 A * 6/1982 Lancaster ..... B65B 11/006 53/399

(Continued)

FOREIGN PATENT DOCUMENTS

DE 202015102804 U1 6/2015
EP 81328 A2 * 11/1982 ..... B65B 67/08
WO 9901347 1/1999

*Primary Examiner* — Hemant Desai
*Assistant Examiner* — Mobeen Ahmed
(74) *Attorney, Agent, or Firm* — Graeser Associates International Inc; Dvorah Graeser

(57) ABSTRACT

An electric stretch film dispenser includes a frame and a power unit. The frame has a top seat and a bottom seat. The top seat and the bottom seat are jointly provided with a film mounting unit and a film dispensing unit. The film dispensing unit has a first roller and a second roller. The first roller is connected with a first power drive unit. The first power drive unit is configured to drive the first roller to rotate. When in use, the film of a film roll is pulled due to different rotational speeds of the first roller and the second roller. Thereby, the electric stretch film dispenser can automatically generate tension when used, so it can be used to pack articles at different heights. The electric stretch film dispenser facilitates the application of the film and increases the tension of the film.

12 Claims, 7 Drawing Sheets

(51) Int. Cl.
*B65B 59/04* (2006.01)
*B65B 11/00* (2006.01)

(52) U.S. Cl.
CPC ..... *B65H 2301/41346* (2013.01); *B65H 2402/412* (2013.01); *B65H 2404/165* (2013.01)

(58) Field of Classification Search
CPC ..... B65H 2404/165; B65H 2402/41; B65H 35/002
See application file for complete search history.

(56) References Cited

U.S. PATENT DOCUMENTS 4,409,777 A * 10/1983 White ..... B65B 11/045 53/214
4,458,467 A 7/1984 Shulman
4,477,037 A * 10/1984 Goldstein ..... B65B 67/085 242/588
4,484,717 A * 11/1984 Goldstein ..... B65H 75/30 242/588
5,193,726 A * 3/1993 Humphrey ..... A47K 10/3827 206/390
5,203,517 A * 4/1993 Parry ..... B65B 67/085 242/422.4
5,352,320 A * 10/1994 Schwartz ..... B65B 67/085 156/577
5,409,177 A * 4/1995 Parry ..... B65H 16/06 242/588
5,442,901 A * 8/1995 Niemela ..... A01D 34/6806 180/65.6
5,759,342 A * 6/1998 Luhman ..... B65H 35/0026 156/577
5,779,179 A * 7/1998 Zentmyer ..... B65B 67/085 242/596.5
D470,371 S * 2/2003 Van Glabbeek ..... D8/51
6,920,742 B1 * 7/2005 Yu Chen ..... B65B 67/085 156/577
7,155,884 B2 1/2007 Cousins
7,437,863 B2 * 10/2008 Moser ..... B65B 67/08 53/210
9,598,196 B2 * 3/2017 Choi ..... B65B 67/085
9,682,790 B2 * 6/2017 Nelson ..... B65B 11/045
9,850,011 B2 * 12/2017 Nelson ..... B65B 61/02
10,059,548 B2 * 8/2018 Chen ..... B65B 61/02
10,279,945 B2 * 5/2019 Nelson ..... B65B 67/085
10,472,115 B2 * 11/2019 Clarke ..... B65B 67/085
10,479,631 B1 * 11/2019 Yu Chen ..... B65B 67/085
10,479,632 B1 * 11/2019 Yu Chen ..... B65H 16/06
10,479,635 B1 * 11/2019 Yu Chen ..... B65H 16/005
10,994,884 B2 * 5/2021 Voo ..... B65H 16/005
11,142,428 B2 * 10/2021 Yu ..... B65H 75/242
2003/0208994 A1 * 11/2003 Gooding ..... B65B 67/085 53/390
2004/0222235 A1 * 11/2004 Hayduk ..... B29B 7/7663 222/145.5
2006/0086517 A1 * 4/2006 Bone ..... H01R 35/02 173/217
2006/0254225 A1 * 11/2006 Lancaster, III ..... B29C 55/06 53/556
2006/0275089 A1 * 12/2006 Dineen ..... B23D 51/01 408/9
2007/0039122 A1 * 2/2007 Zahuranec ..... A47L 9/325 15/340.2
2011/0233321 A1 * 9/2011 Yu Chen ..... B65B 67/085 242/588.2
2012/0293103 A1 * 11/2012 Forster ..... B25F 5/001 318/503
2015/0174750 A1 * 6/2015 Hosking ..... B25F 5/001 173/170
2015/0183542 A1 * 7/2015 Blok ..... B65B 67/085 242/358
2015/0203232 A1 * 7/2015 Nelson ..... B65H 23/06 242/422.4
2015/0353215 A1 * 12/2015 Yu Chen ..... B65B 67/085 53/203
2016/0302636 A1 * 10/2016 Kim ..... A47L 9/0477
2016/0340070 A1 * 11/2016 Yu Chen ..... B65H 16/005
2016/0355373 A1 * 12/2016 Yu Chen ..... B65H 16/005
2017/0332541 A1 * 11/2017 Gyuricza ..... A01D 34/828
2018/0118245 A1 * 5/2018 Chung ..... B62B 5/0043
2019/0377357 A1 * 12/2019 Lee ..... G05D 1/0088
2020/0039675 A1 * 2/2020 Wolf ..... B65H 16/005
2020/0108967 A1 * 4/2020 Voo ..... B65B 67/085
2020/0375102 A1 * 12/2020 Arendt ..... A01D 34/824
2021/0261379 A1 * 8/2021 Yu ..... B65H 16/005

* cited by examiner

DISPENSER FOR STRETCH FILM

The present invention relates to a stretch film dispenser, and more particularly to an electric stretch film dispenser.

In order to prevent damages to articles caused by shaking or falling during storage or transport, a stretch film dispenser is used for packing the articles. Goods that are transported on pallets must comply with legal requirements of stability. A frequently used method for securing pallet loads is the application of a strong and elastic plastic film. This is done with special machines but almost 50% manually. Here the operator has to exert a great deal of pressure and walk backwards with a bended back while he is pulling on the roll. The harder it pulls, the better is load stability. However, this is completely dependent on the method and physical capabilities and capacities of the operator. It is almost impossible to generate consistent load stability in this way. In practice, it has been shown that approximately 20% elongation (=yield) is effectively applied with the film, while the film reaches its optimum strength around 100% elongation. So 80% of the available stretch is unused in the film without offering load stability of the pallet load.

An additional aspect is that with this long reached value of elongation, the possibilities of the film remain largely untapped and therefore a larger amount of film is required to comply with the law.

A conventional stretch film dispenser comprises a rod. One end of the rod is provided with a film mounting unit. The film mounting unit is provided with a film roll. When the user wants to pack an article, the film of the film roll is first pulled out, and then one end of the film is attached to the surface of the article. The user holds the rod to pull the stretch film dispenser for performing the packing operation. However, when packing the article, the film needs to be tensioned on the article to be tightly wrapped around the outside of the article. Although the stretch film dispenser is convenient for the user to pack the article, the length of the rod cannot be adjusted. For the article that is located at a higher or lower position, it is inconvenient for the user to apply a force to pack the article, and the tension of the film is reduced. Besides, the stretch film dispenser mounted with a film roll has a certain weight. When the user wants to pack an article that is located at a lower position or when the user wants to move the stretch film dispenser, it is quite laborious.

The present invention is to provide an electric stretch film dispenser. When in use, the electric stretch film dispenser can automatically generate tension, and it can be used to pack articles at different heights. The electric stretch film dispenser can facilitate the application of the film and increase the tension of the film.

In order to achieve the aforesaid object, the present invention provides a dispenser for stretch film, comprising a frame, provided with a film mounting unit and a film dispensing unit, the film dispensing unit comprising a first roller for guiding a film and a second roller for guiding the film, characterized by at least a first drive unit for driving the first and/or the second roller to rotate.

By providing drive for the first or second roller, the dispenser provides an aid for a user that enables to easily apply a film around an article to be wrapped. Preferably, both the first and the second roller are driven. For that aid, one drive may be sufficient, if a mechanic coupling between the first and second roller is provided. Thereto, in an embodiment, the first roller may be connected with a first gear and the second roller may be connected with a second gear, the first gear meshes with the second gear, and the number of teeth of the second gear is greater than the number of teeth of the first gear, and wherein the first and the second roller comprise a surface provided with friction means for providing friction to the film. The gears may be exchangeable, for changing the ratio between the first and the second roller.

The short distance between the second roller and the first roller assures that the stretch foil does not shrink in its width direction. Through the system of film transport between the rollers, which generate a stretch (for instance 75%), a consistent loading ability is achieved. As a result, a thinner and stronger film can be applied. By driving the rollers, the required tensile force is greatly reduced, thereby helping a user to apply the film with a higher force than is possible without this drive.

In another embodiment, a second drive unit may be present, wherein the first drive unit is configured for driving the first roller and the second power drive unit is configured for driving the second drive roller to rotate. Herein it is preferable that the first and the second drive unit are independently controllable, in particular such that the second roller has a rotational speed less than that the first roller.

It is to be understood that a film, mounted on the film mounting unit, is subsequently guided along the second and the first roller respectively. The rotational speed difference between the second and the first roller combined with the friction means serve to stretch the film a predetermined factor, which may be between 10% and 200% percent, and more in particular between 40% and 160%. 120% stretch means that the foil becomes 220% of the length of the initial 100%.

The speed of the first roller and the speed of the second roller may be adjustable in an embodiment, in order to determine the percentage the film is stretched.

The frame may comprise a top seat and a bottom seat, wherein the top seat is provided with a first retaining trough, a first retaining member is fixedly connected to the first retaining trough, and the first power drive unit is connected to the first retaining member, and wherein the bottom seat is provided with a second retaining trough, a second retaining member is fixedly connected to the second retaining trough.

The first drive unit and the second drive unit may be an electric motor, wherein the dispenser comprises a power unit, for powering the first and/or second drive unit. Such power unit may comprise a power storage member, electrically connected to a charging member. Furthermore a control unit may be present, having at least one sensor, the sensor being electrically connected to the first power drive unit and/or the second power drive unit, the sensor being configured to at least turn on/off the first power drive unit and/or the second power drive unit. Such control unit may further have a power switch, the power switch is electrically connected to the power unit, and the power switch is configured to turn on/off the power unit.

The dispenser may further comprise a handle, coupled to the frame, wherein the handle comprises the sensor, and in particular wherein the sensor is operable by pulling the handle with respect to the frame. Such sensor may then be configured for providing a sensing signal that is proportional to the pulling force exerted on the handle, and wherein the controller is configured to adapt the speed of the first and/or second drive in dependency of the sensing signal. The controller may be configured to adapt the speed of the first and/or second drive such that the pulling force is kept at a predetermined value.

The frame of the dispenser may be provided with a clog up prevention unit, said clog-up prevention unit comprising a cover for covering at least part of the surface of at least one roller at at least a side facing away from the film mounting unit. This prevents the film to cling to the rollers once it is dispensed. Hence, there is some kind of physical barrier between the dispensed film and at least one roller which prevents the dispensed film from clinging to the roller and therewith clogging up the dispenser.

As a result, in such embodiment, the device according to the invention has a force-controlled drive whereby the speed of walking through the operator has no influence on the voltage applied around the load. The speed of film feeding is determined by the tensile force that is set on the device. Thus, as it runs faster, the film feeding will also become faster, the stretch on the film remaining consistent. which reduces the amount of plastic, and with that also the CO2 emissions, which may be up to 70%.

In the electric stretch film dispenser provided by the invention, the first power drive unit is actuated to drive the first roller to rotate, and the rotational speeds of the first roller and the second roller are different. When the film of a film roll passes between the first roller and the second roller, the film is pulled due to the difference in the rotational speed, thereby generating tension. Thereby, the electric stretch film dispenser can automatically generate tension when used, so it can be used to pack articles at different heights. The electric stretch film dispenser facilitates the application of the film and increases the tension of the film.

Embodiments of the present invention will now be described, by way of example only, with reference to the accompanying drawings.

Figure 1:
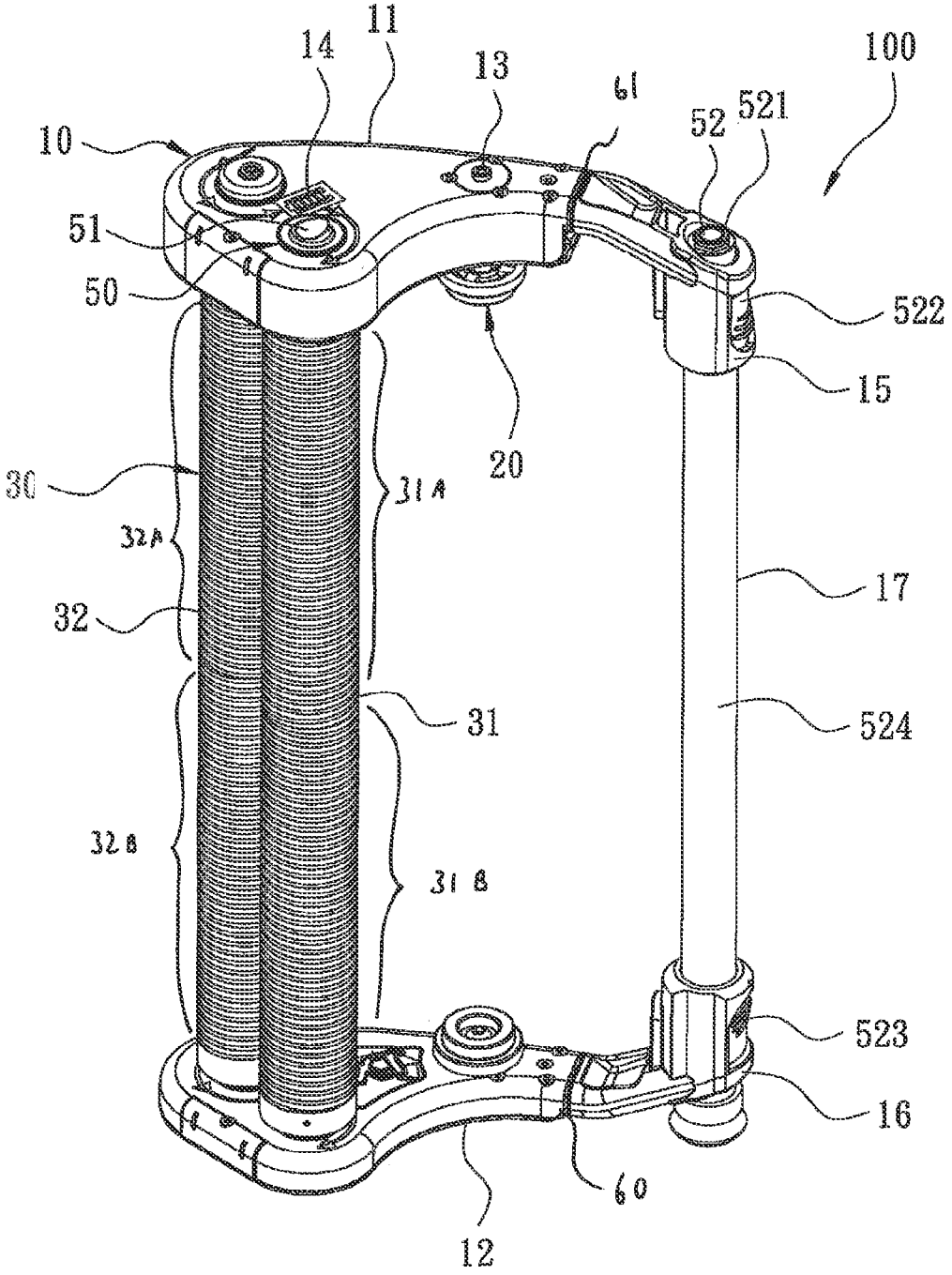
FIG. 1 is a perspective view according to a first embodiment of the present invention.
Figure 2:
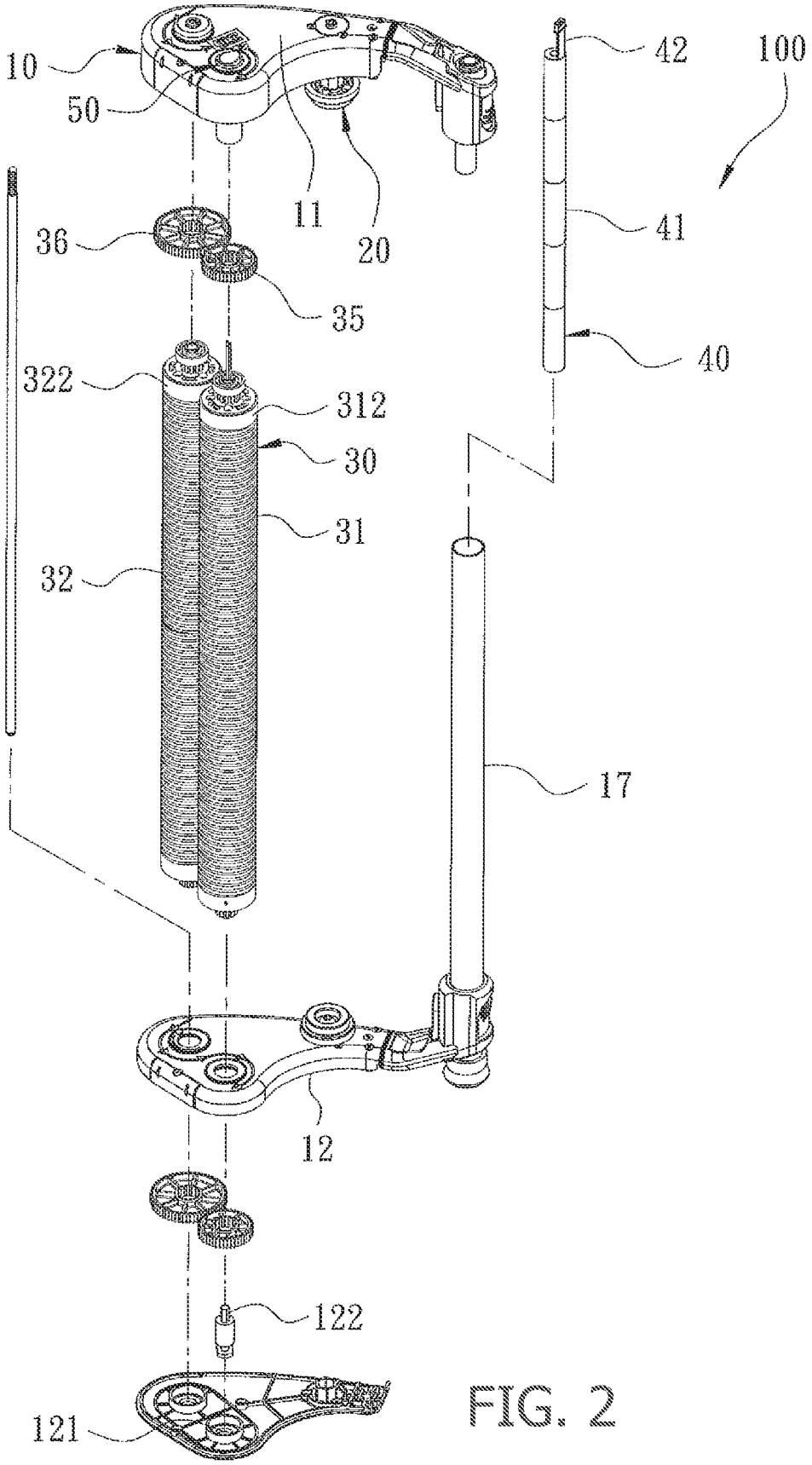
FIG. 2 is an exploded view according to the first embodiment of the present invention.

FIG. 1 and FIG. 2 are a perspective view and an exploded view according to a first embodiment of the present invention. The present invention discloses an electric stretch film dispenser 100, comprising a frame 10, a film mounting unit 20, a film dispensing unit 30, a power unit 40, and a control unit 50.

The frame 10 has a top seat 11 and a bottom seat 12. The top of the top seat 11 is provided with a socket 13 and a panel 14. The socket 13 is used for the electric stretch film dispenser 100 to be charged. The panel 14 is configured to display the power of the battery, so that the user can pay attention to the use of the device at any time. The bottom seat 12 is provided with a first retaining trough 121. A first retaining member 122 is fixedly connected to the first retaining trough 121. In this embodiment of the present invention, the first retaining member 122 is a retaining shaft. Two ends of the first retaining member 122 each have a noncircular cross-section. The two ends of the first retaining member 122 each may have an elliptical or polygonal cross-section. The top seat 11 and the bottom seat 12 are jointly provided with a film mounting unit 20 and a film dispensing unit 30. The top seat 11 and the bottom seat 12 are provided with a first coupling portion 15 and a second coupling portion 16. A hollow tube 17 is connected between the first coupling portion 15 and the second coupling portion 16. The tube 17 is adapted for the user to hold thereon.

The film mounting unit 20 is configured to mount a film roll 200.

Figure 3:
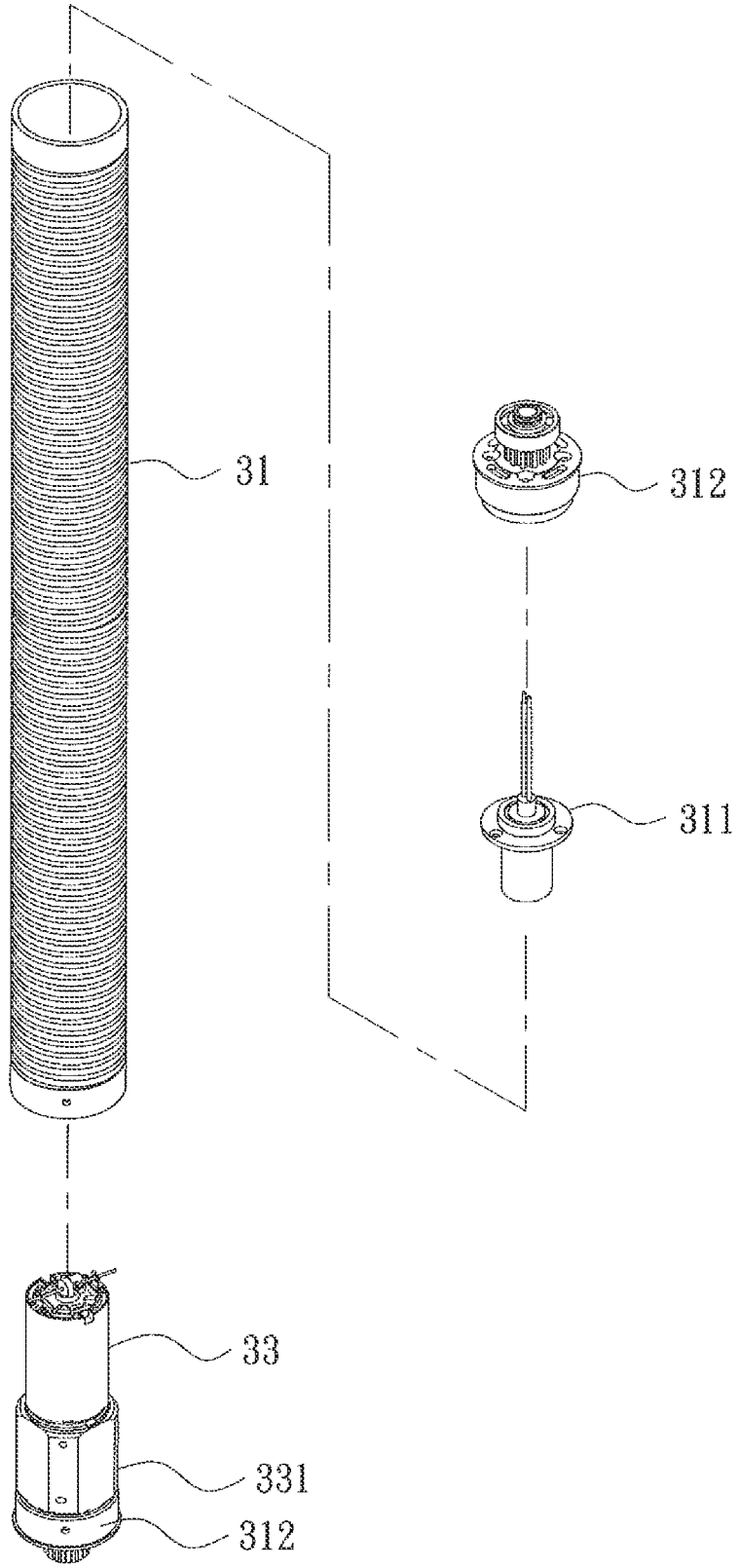
FIG. 3 is a partial exploded view according to the first embodiment of the present invention.

The film dispensing unit 30 includes a first roller 31 and a second roller 32. The first roller 31 and the second roller 32 may be provided with friction means 31A, 31B, 32A, 32B, for instance formed by a rib pattern as shown. The rib pattern has a helix shaped pattern, wherein the orientation is such that the plastic film is moved out from the center, to counteract the tendency of the film to narrow due to the tensile force. The orientation of friction means 31A and 32A may therefore be different from 31B and 32B. This feature can be applied in general, so also without the specific features from this embodiment. As shown in FIG. 3, one end of the first roller 31 is connected with a first power drive unit 33. In this embodiment of the present invention, the first power drive unit 33 is a motor. The first power drive unit 33 is connected with a first gear box 331. The output portions of the first power drive unit 33 and the first gear box 331 are connected to the first retaining member 122. The first power drive unit 33 is electrically connected to a first conductive portion 311. In this embodiment of the present invention, the first conductive portion 311 is a conductive slip ring. The first conductive portion 311 is electrically connected to a power unit 40, so that the first power drive unit 33 can drive the first roller 31 to rotate. The two ends of the first roller 31 are provided with first linking members 312. One of the first linking members 312 is connected with the first power drive unit 33, the first gear box 331 and the first roller 31, so that the first power drive unit 33, the first gear box 331, the first linking member 312 and the first roller 31 can rotate synchronously. Each of the first linking members 312 is connected with a first gear 35. Two ends of the second roller 32 are provided with second linking members 322. Each of the second linking members 322 is connected with a second gear 36. The first gear 35 meshes with the second gear 36. The number of teeth of the second gear 36 is greater than the number of teeth of the first gear 35.

The power unit 40 is electrically connected to the first power drive unit 33. The power unit 40 includes a power storage member 41. The power storage member 41 is electrically connected to a charging member 42 and the panel 14. In this embodiment of the present invention, the power storage member 41 is a battery. The power storage member 41 is disposed in the tube 17. The charging member 42 serves as the charging socket 13. In other embodiments, the power storage member 41 is a plurality of batteries that can be removed from the tube 17. The charging member 42 may be an independent charger for charging the power storage member 41. In another embodiment, the charging member 42 is a wireless charger.

The control unit 50 has a power switch 51 and at least one start switch 52. In this embodiment of the present invention, the start switch 52 includes a plurality of start switches 521, 522, 523, 524. The power switch 51 is disposed on the top of the top seat 11 and electrically connected to the power unit 40. The power switch 51 is configured to turn on/off the power supply of the power unit 40. The start switch 52 is electrically connected to the first power drive unit 33. The start switches 521, 522 are disposed on the top and the side of the first coupling portion 15, respectively. The start switch 523 is disposed on the side of the second coupling portion 16. The start switch 524 is disposed on the tube 17. In this embodiment of the present invention, the start switch 52 may be a push switch, a touch switch or a wireless switch.

The start switch 52 can turn on/off the first power drive unit 33. Alternatively, a force sensor may be present for instance at location 60 or 61, for providing a sensing signal that is proportional to the pulling force exerted on the handle, and wherein the controller is configured to adapt the speed of the first and/or second drive in dependency of the sensing signal.

Figure 4:
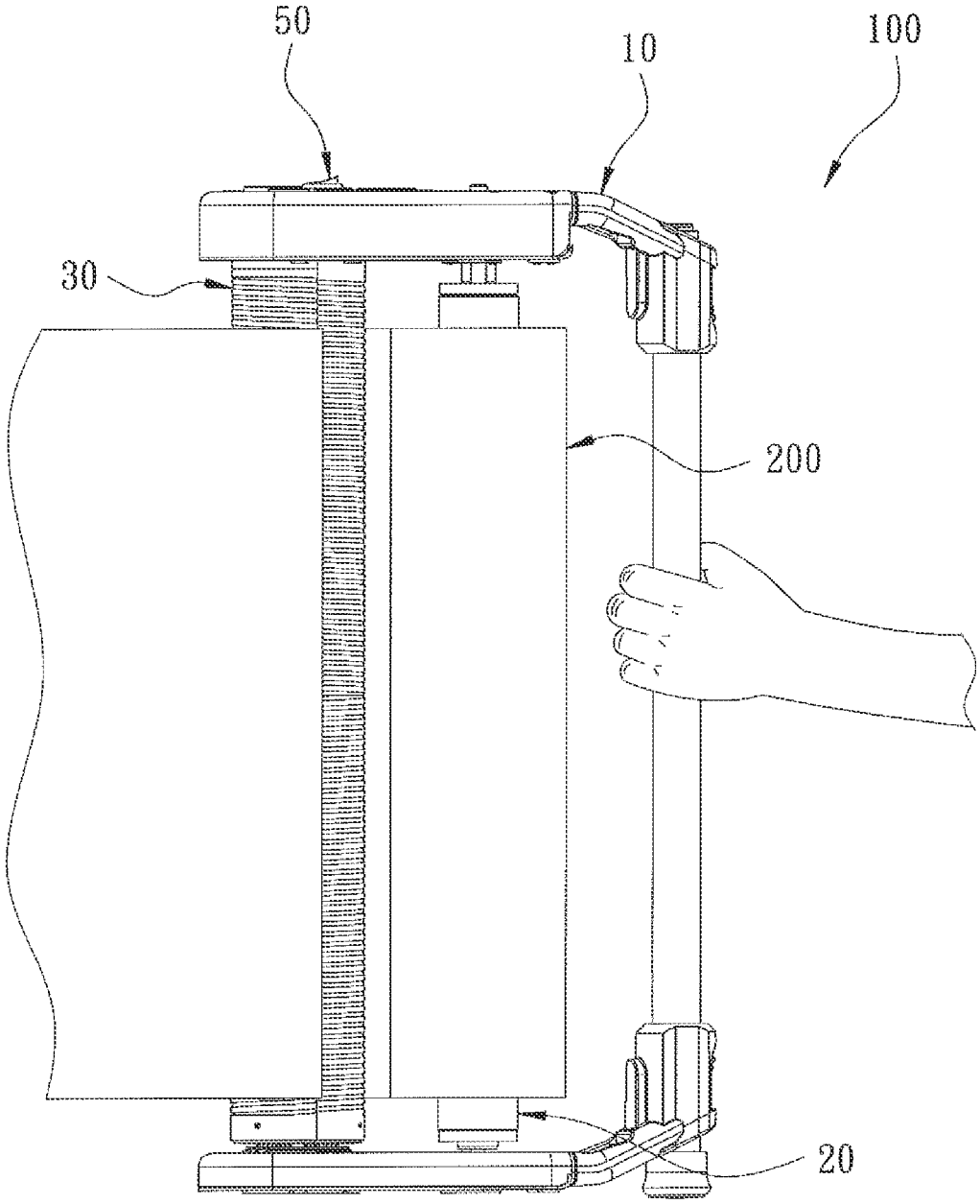
FIG. 4 is a schematic view according to the first embodiment of the present invention when in use.

FIG. 4 is a schematic view according to the first embodiment of the present invention when in use. When the user wants to use the electric stretch film dispenser 100, a film roll 200 is first mounted on the film mounting unit 20, and then the film of the film roll 200 passes through the film dispensing unit 30. Then, the power switch 51 is turned on, and the start switch 52 is turned on to actuate the first power drive unit 33. The output portions of the first power drive unit 33 and the gear box 331 are connected to the first retaining member 122, so that the first power drive unit 33 drives the gear box 331 and the first linking member 312 to rotate the first roller 31. At the same time, the first linking member 311 drives the first gear 35 to rotate, and the first gear 35 drives the second gear 36 to link the second linking member 321 to rotate the second roller 32. Since the number of teeth of the second gear 36 is greater than that of the first gear 35, the rotational speed of the first roller 31 and the rotational speed of the second roller 32 are different. When the film of the film roll 200 passes between the first roller 31 and the second roller 32, the film is pulled due to the difference in the rotational speed, thereby generating tension. Thereby, the electric stretch film dispenser 100 can automatically generate tension when used, so it can be used to pack articles at different heights. The electric stretch film dispenser 100 facilitates the application of the film and increases the tension of the film.

When an article located at a higher or lower position is to be packed, the user can select an appropriate one of the start switches 521, 522, 523, 524 to actuate and control the electric stretch film dispenser 100 conveniently.

It is to be noted that the first power drive unit 33 is electrically connected to the power unit 40 through the first conductive portion 311. The first conductive portion 311 is a conductive slip ring, which can avoid the problem that the electrical components are wound around each other when the first roller 31 rotates, and can maintain an effective electrical connection.

It is worth mentioning that the power storage member 41 and the charging member 42 may be plug-in, battery-replaceable or wirelessly charged, so that the electric stretch film dispenser 100 can maintain a predetermined usage time and the user can know the remaining electric energy through the panel 14 to prepare for charging.

Figure 5:
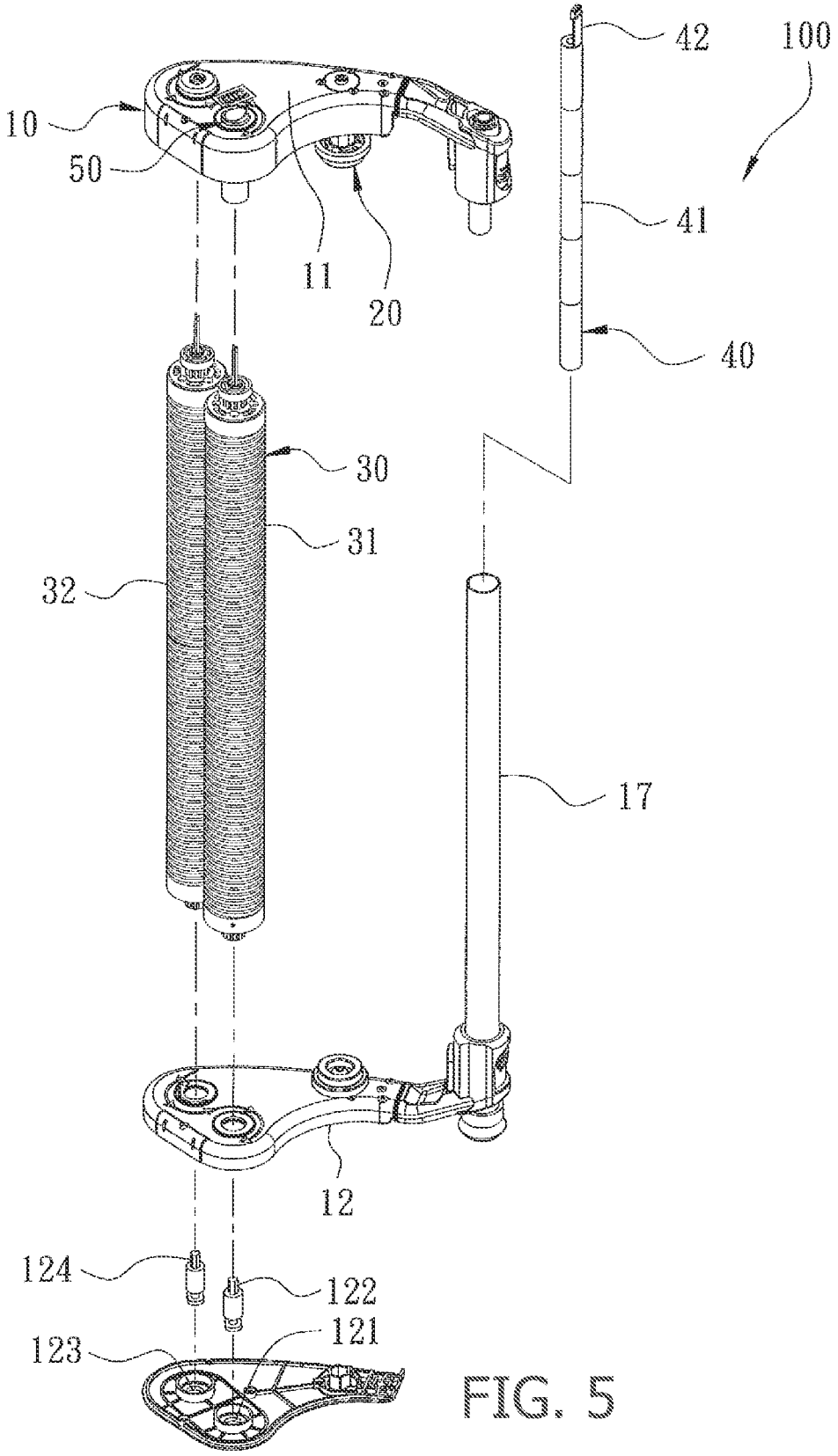
FIG. 5 is an exploded view according to a second embodiment of the present invention.
Figure 6:
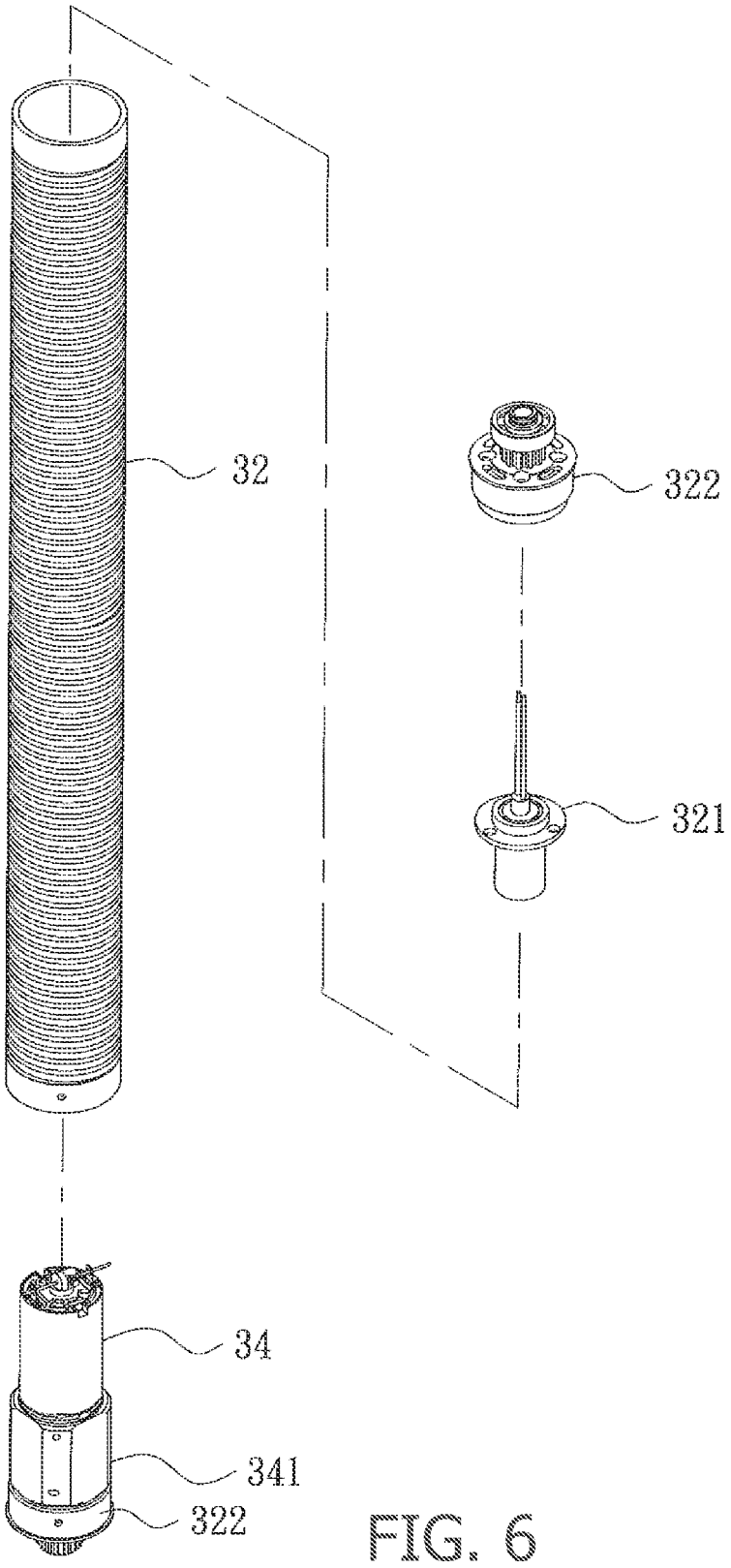
FIG. 6 is a partial exploded view according to the second embodiment of the present invention.

FIG. 5 is an exploded view according to a second embodiment of the present invention. FIG. 6 is a partial exploded view according to the second embodiment of the present invention. The second embodiment is substantially similar to the first embodiment with the exceptions described hereinafter. The bottom seat 12 is provided with a second retaining trough 123. A second retaining member 124 is fixedly connected to the second retaining trough 123. In this embodiment of the present invention, the second retaining member 124 is a retaining shaft. Two ends of the second retaining member 124 each have a noncircular cross-section. The two ends of the second retaining member 124 each may have an elliptical or polygonal cross-section. One end of the second roller 32 is connected with a second power drive unit 34. In this embodiment of the present invention, the second power drive unit 34 is a motor. The second power drive unit 34 is connected with a second gear box 341. The output portions of the second power drive unit 34 and the second gear box 341 are connected to the second retaining member 124. The second power drive unit 34 is electrically connected to a second conductive portion 321. In this embodiment of the present invention, the second conductive portion 321 is a conductive slip ring. The second conductive portion 321 is electrically connected to the power unit 40, so that the second power drive unit 34 can drive the second roller 32 to rotate. The two ends of the second roller 32 are provided with second linking members 322. One of the second linking members 322 is connected with the second power drive unit 34, the second gear box 341 and the second roller 32, so that the second power drive unit 34, the second gear box 341, the second linking member 322 and the second roller 32 can rotate synchronously. The second power drive unit 34 is electrically connected to the power unit 40 and the control unit 50. The rotational speed of the second power drive unit 34 is less than the rotational speed of the first power drive unit 33. When the film of the film roll 200 passes between the first roller 31 and the second roller 32, the film is pulled due to the difference in the rotational speed, thereby generating tension. Thereby, the electric stretch film dispenser 100 can automatically generate tension when used, so it can be used to pack articles at different heights. The electric stretch film dispenser 100 facilitates the application of the film and increases the tension of the film.

Figure 7:
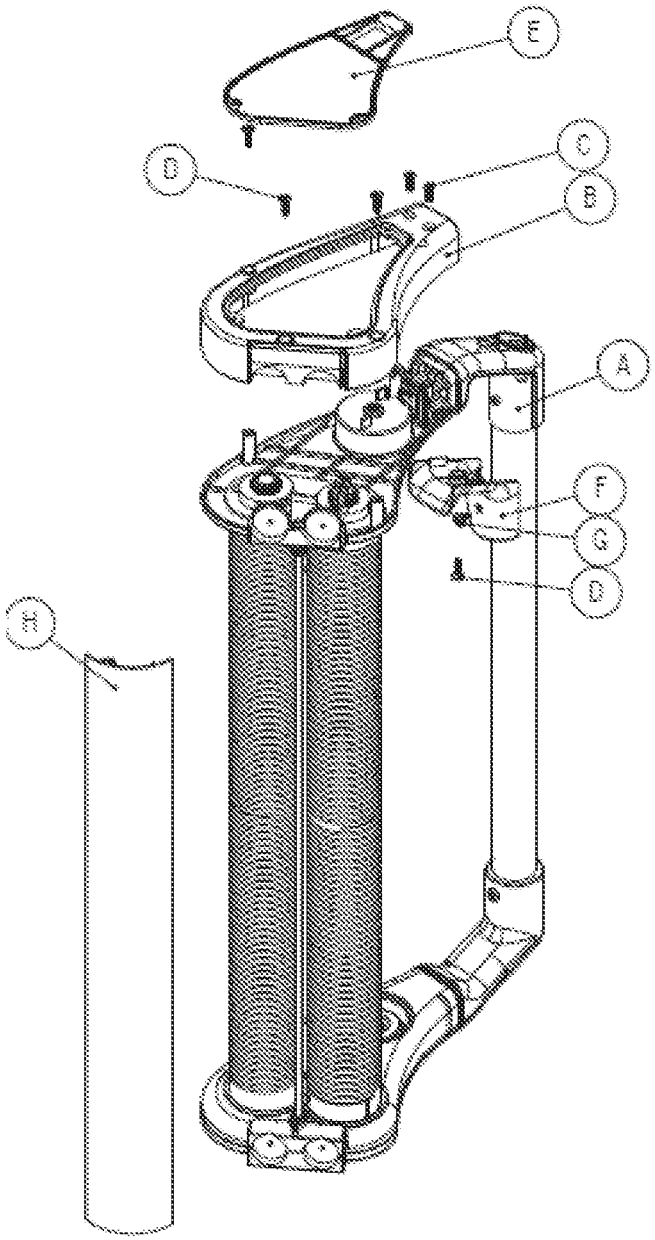
FIG. 7 is an exploded view showing an embodiment of the present invention comprising a clog-up prevention unit.

FIG. 7 shows a partially exploded view of yet another embodiment of the present invention. This embodiment is different with respect to the other embodiments in that the frame 10 has been provided with a clog-up prevention member H. The clog-up prevention unit H is in this figure embodied as a flap H which stretches over substantially the entire length of the rollers 31, 32. The flap H prevents the film from clogging up around the rollers 31, 32. This can occur for example in the event that the tension provided onto the film by the user has dropped whilst the dispenser is still dispensing film. Without the flap H this will increase the likelihood of stretch film clinging, due to the decrease in tension, to one of the rollers 31, 32 and clogging up the rollers. The flap H prevents the film from undesirably clinging to the roller 31, 32 by means of a physical barrier between the film itself and the rollers 31, 32 by which it is dispensed. The flap H is in this embodiment provided in a front area of the first roller 31 since this is the one which is most likely to cause the clogging of the film in case the drive keeps on dispensing film whilst the tension on the film has dropped. However, it is also conceivable that the flap H is provided on a front area of the second roller 32 or on a front area of both. In case the flap covers both front areas of the rollers 31, 32 it is desirably to use two separate flaps, however it is also possible to use a single flap which is provided with a recess through which the film runs.

Although particular embodiments of the present invention have been described in detail for purposes of illustration, various modifications and enhancements may be made.

The invention claimed is:

1. Electric dispenser for stretch film, comprising:

a frame, provided with a film mounting unit and a film dispensing unit, the film dispensing unit comprising a first roller for guiding a film and a second roller for guiding the film, at least one control unit, characterized by at least a first drive unit for driving the first and/or the second roller to rotate, wherein the first drive unit is an electric motor, and wherein the dispenser comprises a power unit, for powering the first drive unit, comprising at least one sensor configured for providing a sensing signal that is proportional to the pulling force exerted on the handle, and wherein the control unit is configured to adapt the speed of the first drive in dependency of the sensing signal;

further comprising a force-controlled drive whereby the speed of film feeding is determined by the tensile force that is set on the device such that the stretch on the film remains consistent.

2. Dispenser as claimed in claim 1, wherein the power unit includes a power storage member, and the power storage member is electrically connected to a charging member.

3. Dispenser as claimed in claim 1, the control unit having the at least one sensor, the sensor being electrically connected to the first drive unit and/or a second power drive unit, the sensor being configured to at least turn on/off the first drive unit and/or the second power drive unit.

4. Dispenser as claimed in claim 1, wherein the control unit further has a power switch, the power switch is electrically connected to the power unit, and the power switch is configured to turn on/off the power unit.

5. Dispenser according to claim 1, whereby the first drive unit is actuated to drive the first roller to rotate, and the rotational speeds of the first roller and the second roller are different.

6. Dispenser according to claim 1, comprising a second power drive unit for controlling the speed of the second roller and wherein the controller is configured to adapt the speed of the first drive unit and/or second power drive unit according to the pulling force.

7. Dispenser according to claim 1, wherein the device is operable by an operator by holding at least part of the dispenser by one hand.

8. Electric dispenser for stretch film, comprising:

a frame, provided with a film mounting unit and a film dispensing unit, the film dispensing unit comprising a first roller for guiding a film and a second roller for guiding the film, characterized by at least a first drive unit for driving the first and/or the second roller to rotate, wherein the first and the second roller comprise a surface provided with friction means for providing friction to the film, wherein the orientation is such that the stretch film is moved out from the center, to counteract the tendency of the film to narrow due to the tensile force, and wherein the first and second roller are independently controllable, such that the film is stretched by a predetermined factor between 10% and 200%;

further comprising a force-controlled drive whereby the speed of film feeding is determined by the tensile force that is set on the device such that the stretch on the film remains consistent.

9. Dispenser according to claim 8, wherein said predetermined factor is between 40% and 160%.

10. Dispenser according to claim 8, wherein the dispenser is manually operable, wherein the device is operable by an operator by holding at least part of the dispenser by one hand, and portable by one hand.

11. Dispenser according to claim 8, wherein said friction means comprises a rib pattern.

12. Dispenser according to claim 11, wherein said rib pattern comprises a helix shaped pattern.

* * * * *